US007824233B2

(12) United States Patent
Thelen

(10) Patent No.: US 7,824,233 B2
(45) Date of Patent: Nov. 2, 2010

(54) ELECTRICAL PLUG CONNECTOR WITH LOCKABLE INSULATING BODY THAT IS UNLOCKABLE WITHOUT TOOLS

(75) Inventor: Maik Thelen, Holzgerlingen (DE)

(73) Assignee: Coninvers GmbH, Herrenberg (DE)

( * ) Notice: Subject to any disclaimer, the term of this patent is extended or adjusted under 35 U.S.C. 154(b) by 0 days.

(21) Appl. No.: 12/685,866

(22) Filed: Jan. 12, 2010

(65) Prior Publication Data

US 2010/0178812 A1 Jul. 15, 2010

(30) Foreign Application Priority Data

Jan. 14, 2009 (DE) ..... 20 2009 000 542 U

(51) Int. Cl.
*H01R 13/502* (2006.01)

(52) U.S. Cl. ..... 439/695

(58) Field of Classification Search ..... 439/695, 439/681, 314, 697, 350, 353, 355
See application file for complete search history.

(56) References Cited

U.S. PATENT DOCUMENTS

| | | | | |
|---|---|---|---|---|
| 4,736,999 | A * | 4/1988 | Marks et al. | 439/314 |
| 4,820,204 | A * | 4/1989 | Batty | 439/681 |
| 7,540,753 | B2 * | 6/2009 | Dobler | 439/346 |
| 2005/0233639 | A1 * | 10/2005 | Blosch et al. | 439/587 |

FOREIGN PATENT DOCUMENTS

| | | |
|---|---|---|
| DE | 40 35 096 | 11/1991 |
| DE | 203 18 251 | 3/2004 |
| DE | 10 2004 018 103 | 9/2005 |
| DE | 20 2006 002 712 | 5/2006 |
| EP | 1 628 367 A1 | 2/2006 |

* cited by examiner

*Primary Examiner*—Chandrika Prasad
(74) *Attorney, Agent, or Firm*—Renner, Otto, Boisselle & Sklar, LLP

(57) ABSTRACT

An electrical plug connector with a tube-shaped housing section in which a multi-part insulating body with electrical contact elements is disposed, with the insulating body having at least one contact carrier with radially inserted contact elements and a contact carrier sleeve element for holding the contact elements that can be pushed onto the contact carrier. The pre-assembled insulating body can be inserted in the axial direction into the housing section from the side of the housing section that is opposite the plug-in side of the plug connector, with the contact carrier being non-permanently lockable with the contact carrier sleeve element and with the contact carrier sleeve element being non-permanently fixable on the housing section. The invention proposes to implement the contact carrier sleeve element with axially arranged spring arms at a rear sleeve end that faces away from the insertion side, with at least one first spring arm having an outer locking element protruding radially towards the housing section, and at least one second spring arm having an inner locking element projecting radially in the direction of the contact carrier.

7 Claims, 3 Drawing Sheets

ELECTRICAL PLUG CONNECTOR WITH LOCKABLE INSULATING BODY THAT IS UNLOCKABLE WITHOUT TOOLS

CROSS-REFERENCE TO RELATED APPLICATION

The present application claims priority under 35 USC §119 to German Patent Application No. 20 2009 000 542.9 filed Jan. 14, 2009, the entire disclosure of which is incorporated herein by reference.

TECHNICAL FIELD OF THE INVENTION

The invention relates to an electrical plug connector with a tube-shaped front housing section in which a multi-part insulating body with electrical contact elements is disposed, with the insulating body having at least one contact carrier with radially inserted contact elements and a contact carrier sleeve element for holding the contact elements that can be pushed onto the contact carrier, which can be inserted in the axial direction into the housing section from the side of the housing section that is opposite the plug-in side of the plug connector, with the contact carrier being non-permanently lockable with the contact carrier sleeve element, and with the contact carrier sleeve element being non-permanently fixable on the housing section.

DESCRIPTION OF THE RELATED ART

A plug connector of this type, in the form of a round plug, is known from EP 1 628 367 A1. In this plug connector, a multi-part contact carrier holds the electrical contacts in contact holders in accordance with a certain pole configuration, with the contact carrier being insertable free of play into a plug housing of the plug connector. The contact carrier consists of several nested contact holders with lockable clamping holders that are associated with the contact elements and which are arranged along the circumference of the cross-sectional shapes, and a cup-shaped contact carrier housing that forms the lock of the clamping holders and overlaps the contact holders for part of their axial length. The contact holders have a multitude of radially arranged clamping holders, connected by webs, for accepting the contact elements. The insulating contact carrier housing with a cylindrical inner surface locks the contact elements in the clamping holders, with the contact carrier housing and contact carrier being lockable to each other in a precise position by means of locking elements that are provided and which permit their locking as well as unlocking. With the contact carrier housing, the contact carrier can be non-permanently fixed in position in the plug connector housing by the locking action.

A great disadvantage of the round plug known from the prior art proved to be especially the large amount of time required for the assembly and disassembly of the plug connector for the purpose of connecting electric supply lines to the contact elements, the main reason being that unlocking the multi-part contact carrier from the plug connector housing and the unlocking of the outer contact holder from the cup-shaped contact carrier housing can only be accomplished by means of a tool, which requires a certain amount of labor.

SUMMARY OF THE INVENTION

Therefore, the invention addresses the problem of proposing a plug connector of this general type wherein the assembly and the disassembly processes of the plug connector are improved especially when the contact carrier, the contact carrier housing, and the housing section accepting the same are locked together in a way that ensures a reliable operation.

The electrical plug connector according to the invention has a contact carrier sleeve element having axially extending spring arms disposed on a rear end of the sleeve that faces away from the insertion side, with at least one first spring arm having an outer locking element protruding radially towards the housing section, and at least one second spring arm having an inner locking element projecting radially in the direction of the contact carrier.

The second spring arm serves to lock the contact carrier with the contact carrier sleeve element after the insertion of the contact carrier into the contact carrier sleeve element. It serves the purpose if, in an end position of the contact carrier relative to the contact carrier sleeve element, the contact carrier locks automatically with the contact carrier sleeve element by means of the inner locking element of the second spring arm. Preferably, this locking action is achieved by means of the inner locking element overlapping the contact carrier at the rear end that is opposite the insertion side of the plug connector, with the front end of the contact carrier supporting itself axially on the contact carrier sleeve element.

The pre-assembled insulating body created in this way can be axially inserted into the front tube-shaped housing section from a rear side of the housing section that is opposite the insertion side of the plug connector, with the first spring arm serving to fix the insulating body in position axially in the receiving housing section in inserted condition. With the insulating body inserted completely into the housing section, the contact carrier sleeve element of the insulating body locks automatically with the housing section as soon as the outer locking element of the first spring arm is precisely aligned opposite a locking recess of complementary shape of the housing section.

It proved to be advantageous to provide at least two each of the first and second spring arms on the contact carrier sleeve element, arranged in symmetrical distribution on the rear end of the sleeve. This offers the advantage that the contact carrier and the contact carrier sleeve element as well as the insulating body and the front housing section of the plug connector are always in highly precise coaxial alignment with each other in the axial direction.

When locked together, the connection of the contact carrier and the contact carrier sleeve element is so secure that the contact carrier does not become detached unintentionally from the contact carrier sleeve element when the insulating body is inserted into the housing section of the plug connector, even with electric supply lines attached to the contact elements. It reliably prevents an undesirable detachment of the contact carrier from the contact carrier sleeve element even when the insulating body is mounted. In the axial direction, the non-permanent fixing of the contact carrier sleeve element in the housing section is push-and-pull resistant. In addition, it secures the locked connection between the contact carrier and the contact carrier sleeve element, making the unlocking of the locked connection between the contact carrier sleeve element of the insulating body and the contact carrier at least more difficult. The insulating body is detached from the surrounding housing section only when the first spring arm is swiveled intentionally so far in the direction of the insulating body that the outer locking element of the contact carrier sleeve element and the locking recess of the housing section disengage. An undesirable unlocking of the plug connector housing, the contact carrier sleeve element and the contact carrier is therefore completely excluded.

Advantageously, the locked connection of the contact carrier and the contact carrier sleeve element cannot be unlocked when the insulating body is locked with the housing section. On the one hand, this ensures the functional reliability, and, on the other hand, the safety of personnel when the electrical plug connector is used as intended. Preferably, this is achieved by the second spring arm supporting itself on the inside of the housing section when the insulating body is inserted in the housing section. This reliably prevents the second spring arm from swiveling in the direction of the housing section, and thus an unintentional unlocking of the locked connection on the insulating body. In order to be able to remove the contact carrier from the contact carrier sleeve element, the insulating body must first be removed from the housing section.

In a preferred embodiment of the invention, the contact carrier has a recess associated with the first spring arm that makes it possible to disengage the outer locking element of the contact carrier sleeve element from the housing section. In this way, the first spring arm of the contact carrier sleeve element can be swiveled, without requiring much force, in the direction of the contact carrier until the locked connection between the insulating body and the housing section is unlocked. With the locked connection unlocked, the insulating body can be removed from the housing section in the opposite direction of its direction of insertion. The accessibility of the first spring arm or its actuation depends essentially on the diameter of the tube-shaped housing section of the plug connector housing and on the protrusion of the first spring arm relative to the contact carrier on the side that is opposite the insertion side of the plug connector. Depending on that, the first spring arm can be actuated only with a tool, or without a tool.

In an advantageous embodiment of the electrical plug connector according to the invention, the housing section enclosing the rear end of the sleeve has an opening in the area of the first spring arm that permits a simplified actuation of the first spring arm. Ideally, the opening is of a size that allows the first spring arm to be pushed with a finger and without a tool in the direction of the contact carrier. This ensures the simple actuation of the first spring arm for the purpose of separating the insulating body from the associated housing section.

In a suitable variant of the electrical plug connector according to the invention, the inner locking element of the second spring arm has flanks that are inclined in the locking and in the development direction. Depending on the stiffness of the second spring arm, this makes it possible to achieve an automatic locking and unlocking of contact carrier and contact carrier sleeve element as soon as an appropriate pushing force is exerted, in the axial direction and against each other, on the contact carrier part or an appropriate pulling force is exerted on the contact carrier. Locking and unlocking are only possible when the insulating body is removed from the housing section, because the second spring arm is only then able to swivel outward in the radial direction.

Below, the invention is explained in detail with reference to an embodiment shown in the drawing. Additional characteristics of the invention are given in the following description of the embodiment of the invention in conjunction with the claims and the attached drawing. The individual characteristics of the invention may be realized either individually by themselves or in combinations of several in different embodiments of the invention.

DETAILED DESCRIPTION OF THE INVENTION

Figure 1:
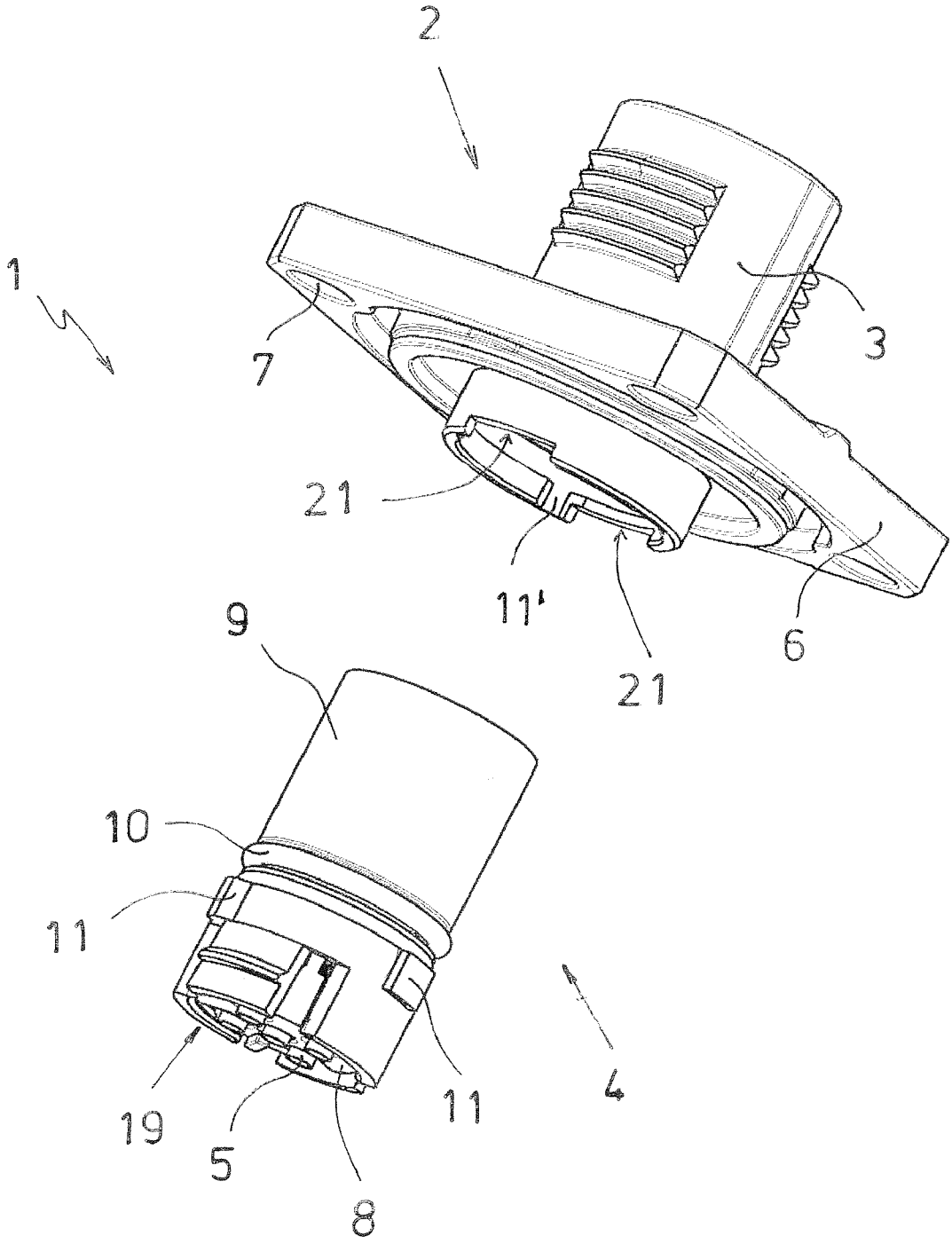
FIG. 1 shows an exploded view in perspective of an embodiment of the electrical plug connector according to the invention.

The embodiment of the invention shown in the drawings is an electrical plug connector in the form of a housing flange. However, the invention is not limited to a flange of this type. Rather, the plug connector housing of the plug connector according to the invention may also be located at the free end of a loose electric line. However, it is indispensable that the plug connector housing, which itself may have a random contour, have a tube-shaped front housing section for accepting the insulating body.

FIG. 1 shows an electrical plug connector 1 according to the invention in the form of a housing flange plug connector. The plug connector 1 has a flange-type plug connector housing 2 with a tube-shaped housing section 3 in which a multipart insulating body 4 with electrical contact elements 5 is disposed.

The insulating body 4 and the housing section 3 have essentially cylindrical shapes. The plug connector housing 2 has a square attachment plate 6 with attachment holes 7 for attaching the plug connector 1 to a connection housing (not shown in the drawing). The insulating body 4 includes a contact carrier 8 with radially inserted contact elements 5 that extend parallel to each other in the contact carrier 8, and a contact carrier sleeve element 9 that encloses the contact carrier 8 at its circumference and encloses the contact elements 5 in the insulating body 4, holding them in stable position therein.

Approximately at its center, the contact carrier sleeve element 9 carries an O-ring 10 for sealing the insulating body 4 from the housing section 3. Also, on the outside of the contact carrier sleeve element 9, axially extending coding webs 11 are formed that permit the insertion of the insulating body 4 into the tube-shaped housing section 3 only when they are aligned in a certain way relative to each other. For this purpose, on the tube-shaped housing section 3, corresponding coding grooves 11' are molded in that are only partially visible in the drawing.

Figure 2:
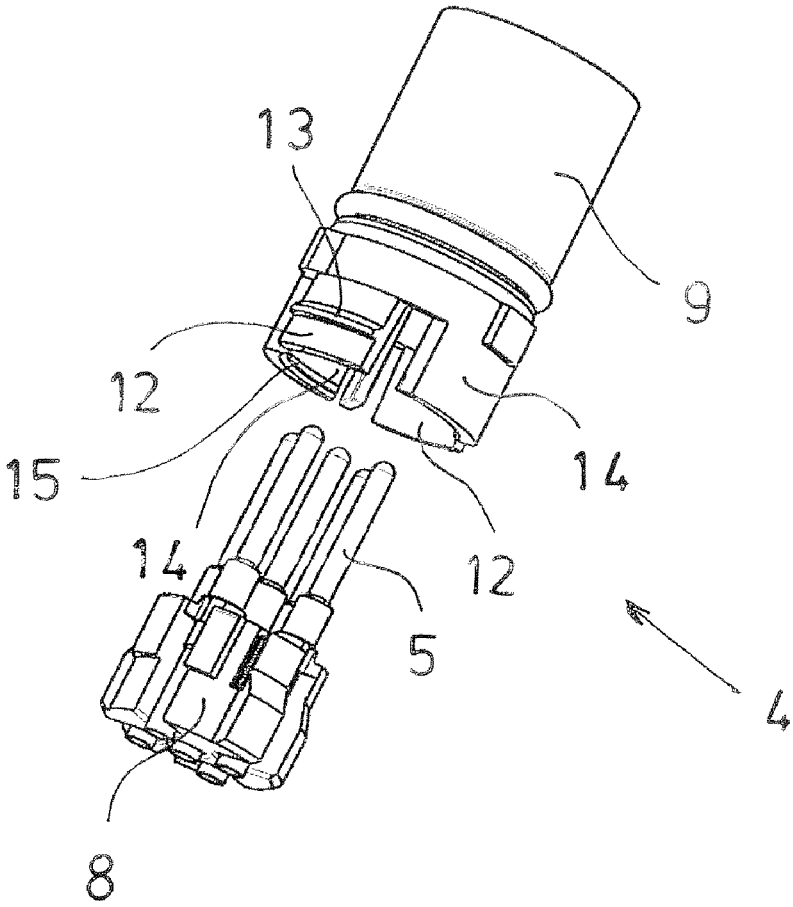
FIG. 2 shows an exploded view in perspective of the insulating body from FIG. 1.

FIG. 2 shows the insulating body 4 from FIG. 1 in disassembled condition. Here, it is easy to see the contact elements 5 placed radially into the contact carrier 8 and, at a rear end 19 of the sleeve of the contact carrier sleeve element 9 that faces away from the insertion side of the insulating body 4, two first spring arms 12 with outer locking elements 13 and two second spring arms 14 with inner locking elements 15. The spring arms 12, 14 extend essentially in the axial direction of the insulating body 4, with the locking element 13 of the first spring arm 12 protruding radially beyond the spring arm 12 towards the housing section 3, and the locking element 15 of the second spring arm 14 projecting radially from the spring arm 14 in the direction of the contact carrier 8. The inner locking element 15 is provided for locking the contact carrier 8 with the contact carrier sleeve element 9, and the outer locking element 13 is provided for locking the contact carrier sleeve element 9 with the housing section 3.

Figure 3:
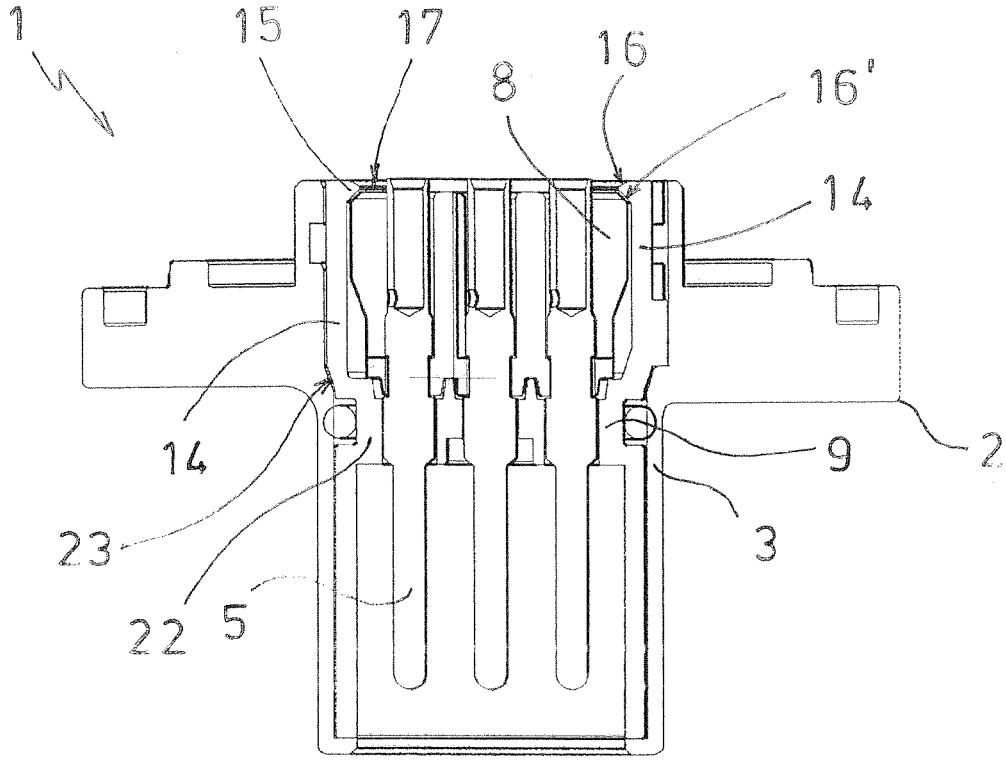
FIG. 3 shows a first axial section view of the electrical plug connector assembled according to FIG. 1.

As FIG. 3 of the assembled plug connector 1 shows in a first longitudinal section view through the center axis of the plug connector 1 and the second spring arms 14, the contact carrier sleeve element 9 has inside a collar-type abutment 22 for the contact carrier 8 on which the locked contact carrier 8 supports itself in the direction of the insertion side of the plug connector housing 2. Also, on its inside, the housing section 3 has a taper 23 as a stop for the contact carrier sleeve element 9 of the insulating body 4 that determines the maximum insertion depth of the insulating body 4 into the housing section 3. In addition, the abutment 22 determines the locked position of the contact carrier 8 axially, and the taper 23 that of the insulating body 4. With the insulating body 4 inserted in the housing section 3, the spring arms 14 contact the housing section 3 on the inside, supporting themselves there radially, while the inner locking elements 15 overlap the contact carrier 8 at a rear end 17. Unlocking the contact carrier 8 from the contact carrier sleeve element 9 is therefore impossible when the insulating body 4 is inserted in the housing section 3.

For locking and unlocking the contact carrier 8, the locking elements 15 of the second spring arms 14 have front and rear locking element flanks 16, 16' that are inclined in, and against the insertion direction of the plug connector 1. When inserting the contact carrier 8 into the contact carrier sleeve element 9 outside the housing section 3, the inclined front locking element flank 16 makes possible the automatic locking of the contact carrier 8 and the contact carrier sleeve element 9. The inclined rear locking element flank 16' causes the automatic unlocking of the contact carrier 8 from the contact carrier sleeve element 9 when the insulating body 4 is not located in the housing section 3, as soon as the contact carrier 8 is pulled away from the contact carrier sleeve element 9 in the axial direction of the insulating body 4, and against the insertion direction of the plug connector housing 2.

Figure 4:
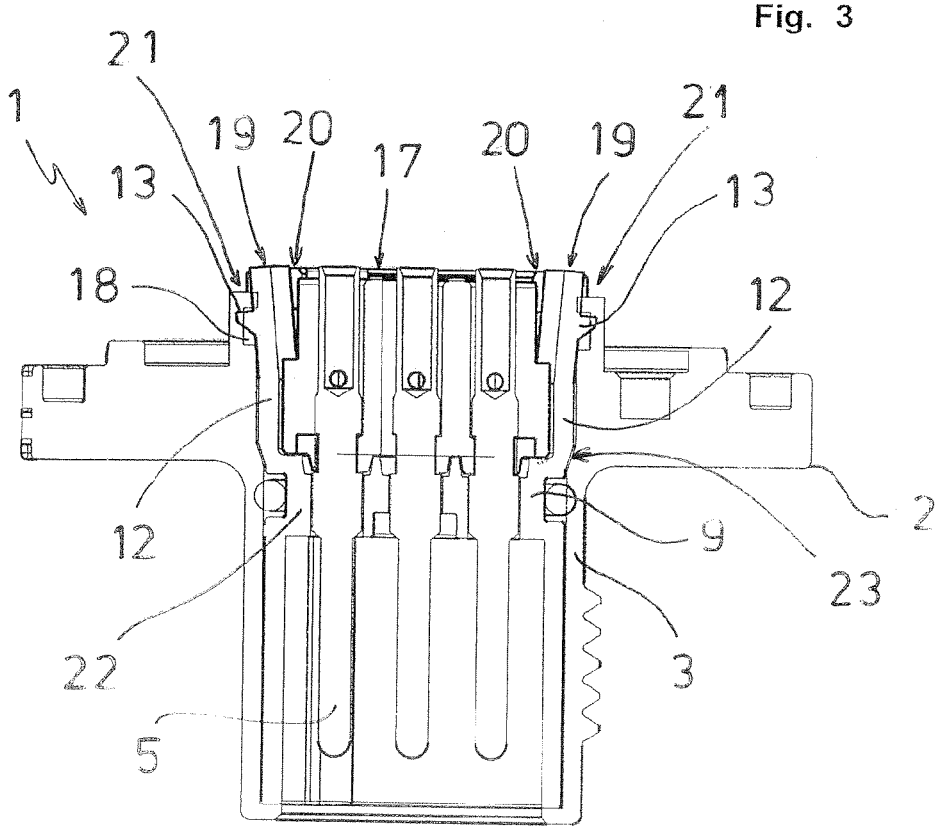
FIG. 4 shows a second axial section view of the electrical plug connector assembled according to FIG. 1.

As FIG. 4 shows, the first spring arms 12 are pre-tensioned in a radially outward direction so that, when the contact carrier 8 is inserted into the contact carrier sleeve element 9, the outer locking elements 13 automatically engage locking recesses 18 of complementary shape that are located at a rear sleeve end 9 of the housing section 3. Unlocking is accomplished by disengaging the spring arms 12 inward in the radial direction towards the contact carrier sleeve element 9. In order to make this possible, associated recesses 20 are provided opposite the spring arms 12 on the rear sleeve end 12 of the contact carrier sleeve element 9 into which the spring arms 12 can be swiveled back with spring action.

In order to achieve good accessibility to the first spring arms 12 for unlocking the insulating body 4 from the housing section 3, the housing section 3 enclosing the rear sleeve end 19 has an opening 21 in the area of the spring arms 12 that makes it possible to actuate the spring arms 12 inward in the radial direction from the outside. On the plug connector housing 2 shown in FIG. 1, the two openings 21 are even easier to see than in FIG. 4. They are of a size that makes it possible to unlock the insulating body 4 from the plug connector housing 2 without tools. Specifically, they permit the disengagement of the outer locking elements 13 of the first spring arms 12 from the locking recesses 18 of the housing section 3 by pushing the first spring arms 12 in the direction of the contact carrier 8 with two fingers.

Further features of the invention can be found in the description of preferred embodiments of the invention in connection with the claims and the drawings. The single features can be realised alone or several together in embodiments of the invention.

The invention claimed is:

1. The electrical plug connector comprising: a tube-shaped housing section in which a multi-part insulating body with electrical contact elements is disposed, with the insulating body having at least one contact carrier with radially inserted contact elements and a contact carrier sleeve element for holding the contact elements that can be pushed onto the contact carrier, which can be inserted in the axial direction into the housing section from the side of the housing section that is opposite the plug-in side of the plug connector, with the contact carrier being non-permanently lockable with the contact carrier sleeve element, and with the contact carrier sleeve element being non-permanently fixable on the housing section, wherein the contact carrier sleeve element has axially arranged spring arms at a rear sleeve end facing away from the insertion side, with at least one first spring arm having an outer locking element protruding radially towards the housing section, and at least one second spring arm having an inner locking element projecting radially in the direction of the contact carrier.

2. The electrical plug connector according to claim 1, wherein the second spring arms support themselves on the inside of the housing section when the insulating body is inserted in the housing section.

3. The electrical plug connector according to claim 1, wherein the contact carrier has an opening associated with the first spring arm that makes it possible to disengage the outer locking element from the housing section.

4. The electrical plug connector according to claim 3, wherein the housing section enclosing the rear sleeve end has an opening in the area of the first spring arm that permits a simplified actuation of the first spring arm.

5. The electrical plug connector according to claim 4, wherein the opening is of a size that makes it possible to push the first spring arm in the direction of the contact carrier without tools.

6. The electrical plug connector according to claim 1, wherein the inner locking element of the second spring arm has flanks that are inclined in the locking and in the unlocking direction.

7. The electrical plug connector according to claim 2, wherein the contact carrier has an opening associated with the first spring arm that makes it possible to disengage the outer locking element from the housing section.

* * * * *